US009249002B2

(12) United States Patent
Bowden

(10) Patent No.: US 9,249,002 B2
(45) Date of Patent: Feb. 2, 2016

(54) LIFT PLATFORM

(75) Inventor: Roger Bowden, Milton Keynes (GB)

(73) Assignee: NIFTYLIFT LIMITED, Milton Keynes (GB)

( * ) Notice: Subject to any disclaimer, the term of this patent is extended or adjusted under 35 U.S.C. 154(b) by 191 days.

(21) Appl. No.: 13/637,146

(22) PCT Filed: Feb. 4, 2011

(86) PCT No.: PCT/GB2011/000162

§ 371 (c)(1),
(2), (4) Date: Dec. 17, 2012

(87) PCT Pub. No.: WO2011/121267

PCT Pub. Date: Oct. 6, 2011

(65) Prior Publication Data

US 2013/0087410 A1 Apr. 11, 2013

(30) Foreign Application Priority Data

Apr. 1, 2010 (GB) ..... 1005607.5

(51) Int. Cl.
*B66F 11/04* (2006.01)

(52) U.S. Cl.
CPC ..... *B66F 11/04* (2013.01); *B66F 11/044* (2013.01)

(58) Field of Classification Search
CPC ..... B62B 19/00; B62B 19/04; E04B 1/34336; B66F 11/04; B66F 11/042; B66F 11/044; B66F 11/046
USPC ..... 182/2.1, 2.2, 2.3, 2.11, 20; 280/7.14, 280/7.17, 30, 32; 248/352
See application file for complete search history.

(56) References Cited

U.S. PATENT DOCUMENTS

| | | | | | |
|---|---|---|---|---|---|
| 1,572,789 | A | * | 2/1926 | Griffin | 280/14.28 |
| 2,750,198 | A | * | 6/1956 | Moore et al. | 280/7.14 |
| 3,222,100 | A | * | 12/1965 | Lindzy | 296/20 |
| 3,225,434 | A | * | 12/1965 | Van Der Lely et al. | 29/430 |
| 3,226,130 | A | * | 12/1965 | Smith | 280/22 |
| 3,335,531 | A | * | 8/1967 | Grimelli et al. | 52/23 |
| 3,422,582 | A | * | 1/1969 | Van Der Lely | 52/79.7 |

(Continued)

FOREIGN PATENT DOCUMENTS

| | | |
|---|---|---|
| EP | 0 581 383 A1 | 2/1994 |
| EP | 1 995 207 | 11/2008 |

(Continued)

OTHER PUBLICATIONS

Hadlow, "Nifty Lets Developments Speak for Themselves," Access International Magazine, online news story dated Jun. 30, 2009, http://www.khl.com/magazines/access-international/detail/item40016/Nifty-lets-developments-speak-for-themselves.

(Continued)

*Primary Examiner* — Colleen M Chavchavadze
(74) *Attorney, Agent, or Firm* — Knobbe Martens Olson & Bear LLP

(57) ABSTRACT

A lift platform includes a base unit (4), a lifting mechanism (8) and an operator cage (14) attached to the lifting mechanism, a set of wheels (16) and a set of static support elements (18). The base unit (4) is constructed and arranged for conversion between a static configuration in which it is supported by the static support elements (18) and a mobile configuration in which it is supported by the wheels (16).

4 Claims, 1 Drawing Sheet

Showing wheels in position on one side and skids on the other

(56) References Cited

U.S. PATENT DOCUMENTS

| | | | | | |
|---|---|---|---|---|---|
| 3,635,434 | A | * | 1/1972 | Chartier | 248/352 |
| 3,653,677 | A | * | 4/1972 | Feser | 280/8 |
| 3,664,082 | A | * | 5/1972 | Zintel | 52/741.15 |
| 3,830,024 | A | * | 8/1974 | Warnke | 52/23 |
| 3,879,905 | A | * | 4/1975 | Catalano, Sr. | 52/23 |
| 3,891,177 | A | | 6/1975 | Jerrel | |
| 3,943,670 | A | * | 3/1976 | Miller | 52/23 |
| 4,014,517 | A | * | 3/1977 | Keagle | 254/45 |
| 4,155,204 | A | * | 5/1979 | Prozinski | 52/69 |
| 4,198,847 | A | * | 4/1980 | Russell et al. | 72/462 |
| 4,241,803 | A | * | 12/1980 | Lauber | 180/8.1 |
| 4,244,593 | A | * | 1/1981 | Malone | 280/8 |
| 4,337,957 | A | * | 7/1982 | Heine | 280/7.14 |
| 4,540,147 | A | * | 9/1985 | Lincourt | 248/352 |
| 4,560,131 | A | * | 12/1985 | Eck | 248/352 |
| 4,585,198 | A | * | 4/1986 | Chartier et al. | 248/352 |
| 4,644,708 | A | * | 2/1987 | Baudot et al. | 52/79.9 |
| D302,958 | S | * | 8/1989 | Shippee et al. | D12/6 |
| 4,937,989 | A | * | 7/1990 | Miyares et al. | 52/126.7 |
| 5,094,048 | A | * | 3/1992 | Woo | 52/143 |
| 5,159,989 | A | * | 11/1992 | Claxton | 180/41 |
| 5,180,177 | A | * | 1/1993 | Maki | 280/47.15 |
| 5,580,095 | A | * | 12/1996 | Fukumoto | 280/766.1 |
| 5,746,286 | A | * | 5/1998 | Mlaker | 182/2.9 |
| 5,950,373 | A | * | 9/1999 | von Hoff et al. | 52/79.5 |
| 6,035,590 | A | * | 3/2000 | Lindsay | 52/143 |
| 6,170,607 | B1 | * | 1/2001 | Freeman et al. | 182/18 |
| 6,173,810 | B1 | * | 1/2001 | Citron et al. | 182/18 |
| 6,250,423 | B1 | * | 6/2001 | Bartsch | 182/2.1 |
| 6,254,132 | B1 | * | 7/2001 | Lindsay | 280/789 |
| 6,325,749 | B1 | * | 12/2001 | Inokuchi et al. | 483/13 |
| 6,449,920 | B1 | * | 9/2002 | Richard | 52/741.15 |
| 6,481,165 | B1 | * | 11/2002 | Romary et al. | 52/122.1 |
| 6,626,441 | B1 | * | 9/2003 | Hanson | 280/7.14 |
| 6,764,083 | B2 | * | 7/2004 | Bernard | 280/30 |
| 7,338,025 | B2 | * | 3/2008 | Pasto | 248/352 |
| 7,543,830 | B2 | * | 6/2009 | Symiczek | 280/79.11 |
| 8,272,647 | B2 | * | 9/2012 | Pendl | 280/7.12 |
| 8,403,342 | B1 | * | 3/2013 | McDaniel | 280/7.12 |
| 2009/0242720 | A1 | | 10/2009 | Charters | |
| 2012/0013083 | A1 | * | 1/2012 | Pendl | 280/7.14 |

FOREIGN PATENT DOCUMENTS

| | | |
|---|---|---|
| GB | 2 102 362 | 1/1983 |
| GB | 2 162 478 | 2/1986 |
| GB | 2 388 582 | 11/2003 |

OTHER PUBLICATIONS

International Search Report in corresponding PCT Application No. PCT/GB2011/000162, dated May 27, 2011.

Search Report in corresponding Great Britain Application No. 1005607.5, dated Jul. 22, 2010.

* cited by examiner

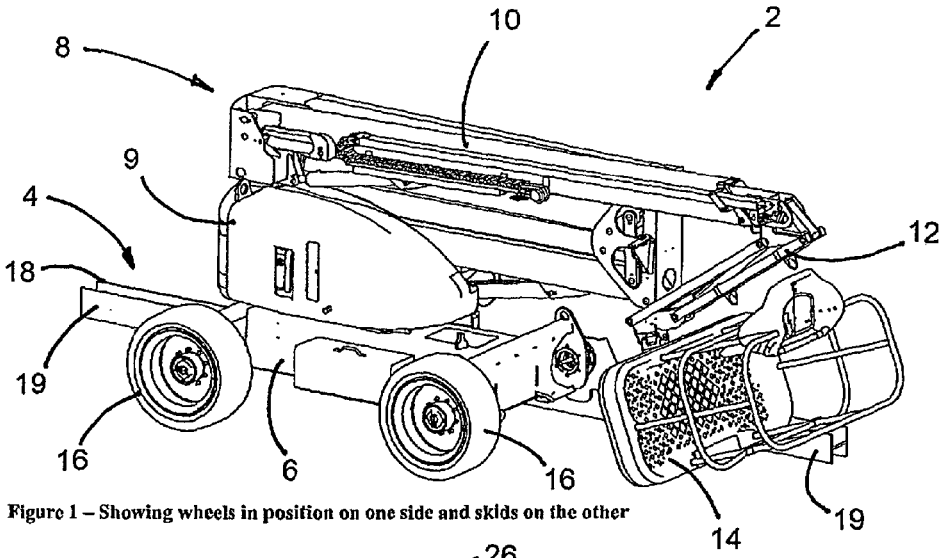
Figure 1 – Showing wheels in position on one side and skids on the other
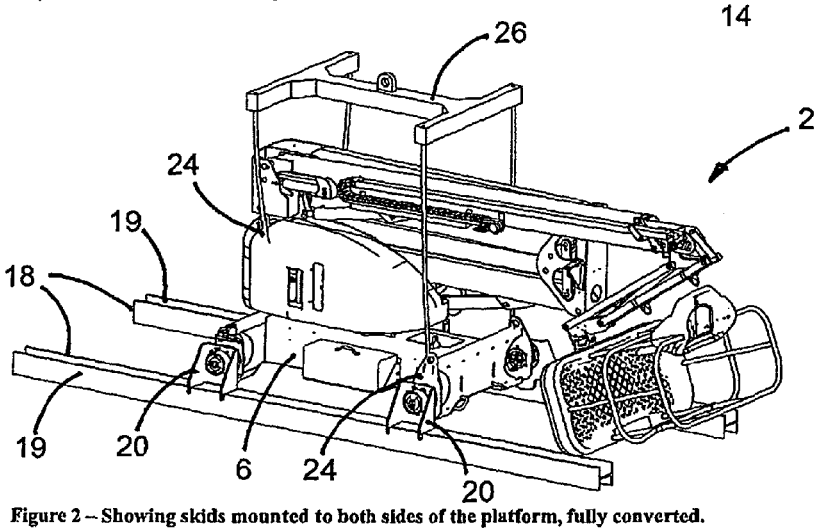
Figure 2 – Showing skids mounted to both sides of the platform, fully converted.
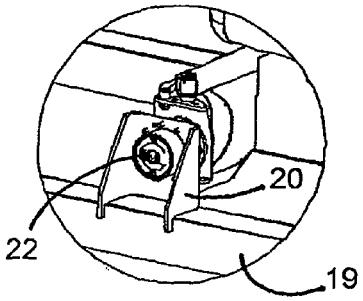
Figure 3 - Gearbox bolts are used as the interface of the self propelled access platform and the skids used for stability.

LIFT PLATFORM

RELATED APPLICATIONS

The instant application is the U.S. National Phase under 35 U.S.C. §371 of International Application No. PCT/GB2011/000162 entitled LIFT PLATFORM, filed Feb. 4, 2011, designating the U.S., which claims priority under 35 U.S.C. §119(a)-(d) to Great Britain Patent Application No. 1005607.5, filed Apr. 1, 2010, the content of which are herein incorporated by reference in its entirety.

FIELD OF THE INVENTION

The present invention relates to a lift platform having an operator cage mounted on the end of an adjustable boom arm.

BACKGROUND OF THE INVENTION

Lift platforms are widely used in the construction industry to allow construction operators to gain access safely to locations at heights of typically up to about 20 meters or more above ground or floor level, and perform construction operations at those locations.

A lift platform usually includes a base unit, a lift mechanism including a boom arm and an operator cage mounted on the end of the arm. The base unit includes a drive motor and a hydraulic drive system for driving movement of the lift mechanism. The operator cage includes a control console allowing the operator to control movement of the cage.

As lift platforms are generally free standing, the base unit must be sufficiently heavy to ensure that the lift platform is stable at all times. Generally, the largest turning moment will occur when the boom arm is at its maximum extension to one side of the base unit and the operator cage is carrying its maximum permissible load. Typically, the base unit might have a weight in the range of 5-6 tonnes.

Some lift platforms, known as mobile lift platforms, are fitted with motorised wheels or tracks that allow the lift platform to be driven from one location to another. This is very useful as it allows the lift platform to be moved easily to new locations as required.

Sometimes, mobile lift platforms are used during the erection of multi storey (steel framed or other) buildings and are lifted by a tower crane onto each successive floor of the building as it is constructed. This allows the operator to take part in construction of the steel framework for the next floor. However, there is a disadvantage with this working method. Each floor of the building is generally constructed by laying a steel deck and then casting a floor slab of reinforced concrete on top of the steel deck. Owing to the weight of a typical mobile lift platform and the fact that this weight is concentrated on a rather small area represented by the "footprint" of the wheels, the concrete must be allowed to harden fully before the mobile lift platform can be lifted into position. This may take several days, delaying construction of the building.

Also, the weight of the mobile lift platform is limited by the lifting capacity of the tower crane, which is typically 5000 kg (although cranes with larger lifting capacities are known). This means that only relatively small, lightweight mobile lift platforms can be used.

These problems can be avoided by using a static base lift platform, such as the DR15 platform from Niftylift Limited. This lightweight lift platform has a base unit mounted on a rigid sled comprising two parallel skids, each with a length of approximately 6 meters. These rails spread the weight of the lift platform, allowing it to be placed directly on a steel floor deck, before the reinforced concrete floor slab has been cast. The lift platform can then be used to erect the framework for the next floor, after which it can be lifted onto that floor allowing the concrete to be laid on the previous floor. The construction process can proceed considerably more quickly as a result.

Another benefit of using static base lift platforms is that they tend to be lighter than similarly sized mobile lift platforms. This permits a lighter steel frame structure to be designed into the building, allowing for more efficient design, lower material content and reduced costs.

Although static base lift platforms provide significant advantages over mobile lift platforms in this situation, one disadvantage is that they generally have little use after the main framework of the building has been constructed. They therefore lack the flexibility of mobile lift platforms and have to be transported away from the building site for use elsewhere, or stored on site causing a significant under use of capital resources.

It is an object of the present invention to provide a lift platform that mitigates at least some of these disadvantages.

SUMMARY OF THE INVENTION

According to one aspect of the present invention there is provided a lift platform including a base unit, a lifting mechanism and an operator cage attached to the lifting mechanism, a set of wheels and a set of static support elements, wherein the base unit is constructed and arranged for conversion between a static configuration in which it is supported by the static support elements, and a mobile configuration in which it is supported by the wheels.

It should be understood that the term "wheels" as used herein is intended to encompass both plain wheels and also support wheels for the tracks of a tracked mobile lift platform.

When the lift platform is configured for static operation it is supported on static support elements, for example skids, that spread the weight of the lift platform and allow it to be placed directly on a steel floor deck before the concrete floor slab has been cast. This allows erection of the steel framework of the building to proceed more rapidly. The lift platform may also be relatively lightweight (preferably less than 5000 kg) allowing it to be lifted readily by a typical tower crane.

The lift platform may also be converted readily to the mobile configuration by removing the skids and attaching wheels. It can therefore be used more flexibly on floors where the concrete floor slab has been cast and at other locations around the building site. Underuse of capital resources is therefore avoided and the need to transport equipment to and from the building site is reduced.

The base unit may be constructed and arranged to be attached alternatively to the wheels or the static support elements. In this embodiment, the static support elements are preferably constructed and arranged to be attached to wheel mountings, after removal of the wheels. This simplifies the operation to convert the lift platform between the two configurations and avoids the need for additional mounting points for the static support elements. Preferably, the lift platform includes control means for aligning the wheel mountings for attachment to the static support elements.

Alternatively, the static support elements may be constructed and arranged to be attached to the base unit, after removal of the wheels and gearboxes associated with the wheels.

The base unit preferably includes drive motors for driving the wheels, allowing self-propelled operation when in the mobile configuration. The wheel drive motors are preferably hydraulic drive motors, which are driven from the same hydraulic drive system as the lifting mechanism. Alternatively, electric motors may be provided.

The lift platform preferably includes means for preventing operation of the wheel motors when the static support elements are attached to the base unit.

Advantageously, the static support elements comprise elongate skids. Preferably, each static support element includes a plurality of mounting brackets attached to the elongate skid. The separation of the mounting brackets is preferably matched to the separation of the wheel mountings, allowing the skids to be attached to the wheel mountings after removal of the wheels.

Advantageously, the lift platform includes lifting points for lifting the lift platform.

The lift platform preferably has a weight of no more than 8000 kg when in a static configuration, and ideally 5000 kg or less.

According to another aspect of the present invention there is provided a static support element for a lift platform including a base unit, a lifting mechanism, an operator cage attached to the lifting mechanism and a set of wheels mounted to wheel mountings, the static support element including an elongate skid and a plurality of mounting brackets attached to the elongate skid, the mounting brackets being constructed and arranged for attachment to the wheel mountings after removal of the wheels in order to convert the lift platform from a mobile configuration in which it is supported by the wheels to a static configuration in which it is supported by static support elements.

A set of static support elements can be provided to allow conversion of a conventional mobile lift platform to a static configuration, allowing it to be placed on a steel floor deck during construction of a building, as described above.

The elongate skid may have a length in the range 3-8 m, preferably about 6 m.

An embodiment of the invention will now be described by way of example, with reference to the accompanying drawings, in which:

BRIEF DESCRIPTION OF THE DRAWINGS

FIG. 1 is an isometric view of a lift platform during conversion from a mobile configuration to a static configuration;

FIG. 2 is an isometric view of the lift platform in a static configuration, attached to a lifting rig, and FIG. 3 is an isometric view at an enlarged scale showing part of the lift platform in a static configuration.

DETAILED DESCRIPTION OF THE PREFERRED EMBODIMENT

The lift platform shown in FIGS. 1-3 is based on an existing mobile lift platform design, for example the HR15N mobile lift platform from Niftylift Limited. The lift platform 2 includes a base unit 4 comprising a rigid chassis 6 on which the lifting mechanism 8 is mounted. The lifting mechanism 8 includes a rotatable turret 9, an extendable boom arm 10 and a fly boom 12. An operator cage 14 is mounted on the end of the fly boom 12.

Mounted within the chassis 6 and/or the lower turret part 9 of the lifting mechanism 8 (but not shown in the drawings) is a drive motor, for example an internal combustion engine and/or an electric motor, and a hydraulic drive system for driving the lifting mechanism 8. These parts are all conventional and will not therefore be described in further detail.

The chassis 6 is designed to be supported either on wheels 16 or on steel skids 18 and is convertible for either mobile or static operation. When configured for mobile operation, it is mounted on four wheels 16, which can be driven by hydraulic drive motors (not shown) via the hydraulic drive system, or by electric drive motors. The wheels are attached to the chassis 6 at four wheel mountings 22.

Alternatively, the lift platform 2 can be configured for static operation by removing the wheels 16 and replacing them with two elongate skids 18. Each skid 18 comprises a steel H-section girder 19 having two mounting brackets 20 that are attached to the girder 19 at a separation corresponding to the separation of the wheel mountings 22 on one side of the chassis 6. Therefore, when the wheels 16 have been removed from the chassis 6, the skids 18 can be attached to the wheel mountings 22, for example using wheel bolts.

Preferably, the drive system for the driven wheels includes a control mechanism (not shown) for driving the wheel motors so that the wheel mountings 22 are aligned correctly for attachment to the mounting brackets 20 of the skids 18. This control mechanism may take numerous forms: for example it can include one or more mechanical stops that engage the wheels or the wheel mountings when they are in the correct positions for attachment to the mounting brackets, or it may include electronic sensors that sense the rotational positions of the wheels and provide feedback to an electronic control unit, which interrupts drive to the wheel motors when the wheel mountings are in the correct positions.

FIG. 1 shows the lift platform partially converted from a mobile configuration to a static configuration, having two wheels 16 attached to one side of the chassis 6 and a skid 18 mounted to the other side of the chassis. FIG. 2 shows the lift platform fully converted to a static configuration, with skids 18 attached to both sides of the chassis 6.

The lift platform 2 includes a number of lifting points 24, allowing it to be attached to a lifting rig 26 as shown in FIG. 2. In this example, two lifting points 24 are attached to the chassis 6 adjacent the front wheel mountings 22 and two of the lifting points 24 are attached to the turret 9. The lifting points may of course be located in other positions. The lifting points 24 allow the lift platform 2 to be lifted into position as required during construction of a building, for example using a tower crane.

The lift platform may include means for automatically preventing operation of the hydraulic or electric wheel motors when the skids 18 are attached. This may take various different forms. For example, the mounting mechanism of the skids may include a hydraulic isolation valve that is actuated when the skids are attached so as to isolate the hydraulic wheel motors from the hydraulic system. Alternatively, the lift platform may include an electronic isolation system including a switch that is actuated by attaching the skids, which electronically prevents actuation of the hydraulic or electric motors when the skids are attached.

Various modifications of the lift platform described above are of course possible. For example, the skids 18 may be designed to be attached to the chassis 6 at separate mounting points instead of the wheel mountings 22. In this case, it may be possible to attach the skids 18 without removing the wheels 16, albeit at the expense of an increase in the weight of the lift platform. Alternatively, the wheels (and also possibly the gearboxes) may be removed to reduce the weight of the lift platform.

The invention is also applicable to tracked mobile lift platforms.

The mounting brackets 20 may be extended to locate the skids 18 outwards relative to the wheel mountings 22, thereby increasing the overall width and stability of the lift platform.

The invention claimed is:

1. A lift platform that is convertible for static or mobile operation, the lift platform, including:

a base unit;

a lifting mechanism mounted on the base unit;

an operator cage attached to the lifting mechanism;

a set of removable wheels;

drive motors for driving the wheels; and a pair of static support elements each comprising an elongate girder having a length in the range of 3-8 meters and a plurality of mounting brackets attached to the elongate girder, wherein each static support element is attachable to the base unit after removal of the wheels and subsequently removable from the base unit, wherein the base unit is attached alternatively to the wheels, or to the static support elements, or a combination thereof, and is convertible between a static configuration in which the wheels are removed from the base unit and the base unit is supported by the static support elements, and a mobile configuration in which the static support elements are removed from the base unit and the base unit is supported by the wheels, wherein the lift platform further includes lifting points on the base unit for attaching the lift platform to a lifting rig of a crane for lifting the lift platform to a static operating location while the lift platform is in the static configuration, and wherein the lift platform includes means for automatically preventing operation of the drive motors when the static support elements are attached to the base unit.

2. The lift platform according to claim 1, wherein the static support elements are attached to wheel mountings, after removal of the wheels.

3. The lift platform according to claim 2, further including control means for aligning the wheel mountings for attachment to the static support elements.

4. The lift platform according to claim 1, wherein the wheel drive motors are hydraulic or electric drive motors.

* * * * *